US009133735B2

(12) United States Patent
Rotter et al.

(10) Patent No.: US 9,133,735 B2
(45) Date of Patent: Sep. 15, 2015

(54) VARIABLE VALVE TIMING APPARATUS AND INTERNAL COMBUSTION ENGINE INCORPORATING THE SAME

(71) Applicant: Kohler Co., Kohler, WI (US)

(72) Inventors: Terrence M. Rotter, Sheboygan Falls, WI (US); Kevin C. Bruso, Malone, WI (US); Steven P. Lewis, Howards Grove, WI (US)

(73) Assignee: KOHLER CO.

( * ) Notice: Subject to any disclaimer, the term of this patent is extended or adjusted under 35 U.S.C. 154(b) by 153 days.

(21) Appl. No.: 13/838,032

(22) Filed: Mar. 15, 2013

(65) Prior Publication Data

US 2014/0261264 A1 Sep. 18, 2014

(51) Int. Cl.

| | |
|---|---|
| ***F01L 1/34*** | (2006.01) |
| ***F01L 1/14*** | (2006.01) |
| ***F01L 1/18*** | (2006.01) |
| ***F01L 13/00*** | (2006.01) |
| ***F02B 75/22*** | (2006.01) |
| *F02B 75/18* | (2006.01) |

(52) U.S. Cl.

CPC . *F01L 1/34* (2013.01); *F01L 1/146* (2013.01); *F01L 1/183* (2013.01); *F01L 13/0063* (2013.01); *F02B 75/22* (2013.01); *F02B 2075/1808* (2013.01)

(58) Field of Classification Search

CPC ..... F01L 2013/0073; F01L 2013/0068; F01L 13/0063

USPC ..... 123/90.16, 90.39, 90.44

See application file for complete search history.

(56) References Cited

U.S. PATENT DOCUMENTS

| | | | |
|---|---|---|---|
| 3,626,720 | A | 12/1971 | Meacham et al. |
| 4,036,185 | A | 7/1977 | Key |
| 4,091,776 | A | 5/1978 | Clemens et al. |
| 4,131,096 | A | 12/1978 | Mitchell |
| 4,305,352 | A | 12/1981 | Oshima et al. |
| 4,469,056 | A | 9/1984 | Tourtelot, Jr. et al. |
| 4,498,431 | A | 2/1985 | Nakamura et al. |
| 4,561,390 | A | 12/1985 | Nakamura et al. |
| 4,594,972 | A | 6/1986 | Ma |
| 4,603,663 | A | 8/1986 | Giocastro |
| 4,682,575 | A | 7/1987 | Simko |
| 4,708,101 | A | 11/1987 | Hara et al. |
| 4,754,727 | A | 7/1988 | Hampton |
| 4,811,698 | A | 3/1989 | Akasaka et al. |
| 4,903,651 | A | 2/1990 | Matsuura et al. |
| 5,078,647 | A | 1/1992 | Hampton |
| 5,107,804 | A | 4/1992 | Becker et al. |
| 5,161,494 | A | 11/1992 | Brown |
| 5,234,088 | A | 8/1993 | Hampton |
| 5,243,938 | A | 9/1993 | Yan |
| 5,335,636 | A | 8/1994 | Belei et al. |

(Continued)

FOREIGN PATENT DOCUMENTS

| | | | |
|---|---|---|---|
| EP | 2136054 | A1 * | 12/2009 |
| WO | 2005068788 | | 7/2005 |

*Primary Examiner* — Thomas Denion
*Assistant Examiner* — Daniel Bernstein
(74) *Attorney, Agent, or Firm* — The Belles Group, P.C.

(57) ABSTRACT

A variable valve timing apparatus, and internal combustion engine incorporating the same, that allows the timing of the opening and/or closing of intake and/or exhaust cylinder valves to be altered relative to a reference timing. As a result, the timing of the valve event can be adjusted relative to a phase of the crankshaft and/or the cycle of the pistons.

21 Claims, 12 Drawing Sheets

(56) References Cited

U.S. PATENT DOCUMENTS 5,365,895 A 11/1994 Riley
5,555,860 A 9/1996 Wride
5,572,962 A 11/1996 Riley
5,651,336 A 7/1997 Rygiel et al.
5,666,913 A * 9/1997 Gustafson et al. ..... 123/90.16
5,713,335 A * 2/1998 Perr et al. ..... 123/501
5,832,887 A 11/1998 Adachi et al.
5,937,809 A 8/1999 Pierik et al.
5,960,757 A 10/1999 Ushida
6,135,076 A 10/2000 Benlloch
6,155,216 A 12/2000 Riley
6,192,844 B1 2/2001 Scheidt et al.
6,276,321 B1 8/2001 Lichti et al.
6,332,439 B2 12/2001 Sekiya et al.
6,349,688 B1 2/2002 Gracyalny et al.
6,354,265 B1 3/2002 Hampton et al.
6,382,150 B1 5/2002 Fischer
6,386,166 B1 5/2002 Scott et al.
6,401,677 B1 6/2002 Rohe et al.
6,439,177 B2 8/2002 Pierik
6,439,182 B1 8/2002 Sugiura et al.
6,443,112 B1 9/2002 Kinugawa
6,516,763 B1 2/2003 Strauss
6,520,132 B2 2/2003 Todo
6,550,435 B1 4/2003 Zubeck
6,584,943 B1 7/2003 Klotz
6,588,387 B2 7/2003 Cecur
6,615,775 B2 9/2003 Takemura et al.
6,622,677 B2 9/2003 Simpson et al.
6,637,390 B1 10/2003 Dauer et al.
6,651,600 B1 11/2003 Schafer et al.
6,659,053 B1 12/2003 Cecur
6,691,655 B2 2/2004 Aoyama et al.
6,715,456 B2 4/2004 Wurms et al.
6,722,329 B2 4/2004 Pierik et al.
6,732,693 B2 5/2004 Ito et al.
6,736,096 B2 5/2004 Pierik
6,742,485 B2 6/2004 Lichti
6,745,734 B2 6/2004 Pierik
6,745,735 B2 6/2004 Smith
6,766,777 B2 7/2004 Simpson et al.
6,840,201 B2 1/2005 Miura
6,854,434 B2 2/2005 Methley
6,883,478 B2 4/2005 Borraccia et al.
6,948,467 B2 9/2005 Lipke et al.
6,978,751 B2 12/2005 Rotter et al.
6,988,473 B2 1/2006 Rohe et al.
7,044,094 B2 5/2006 Bosl-Flierl et al.
7,063,058 B1 6/2006 Armour et al.
7,077,088 B1 7/2006 Decuir
7,117,831 B2 10/2006 Methley
7,156,059 B2 1/2007 Yokoyama et al.
7,159,550 B2 1/2007 Maekawa
7,261,074 B2 * 8/2007 Kim et al. ..... 123/90.16
7,296,546 B2 11/2007 Schon et al.
7,318,400 B2 1/2008 Lipke et al.
7,322,324 B2 1/2008 Hara et al.
7,363,893 B2 4/2008 Rohe et al.
7,363,899 B2 4/2008 Best et al.
7,398,750 B2 7/2008 Fujita et al.
7,421,989 B2 9/2008 Fischer et al.
7,421,991 B2 9/2008 Lequesne et al.
7,426,913 B2 9/2008 Arinage et al.
7,434,556 B2 * 10/2008 Harmon ..... 123/90.44
7,438,042 B1 10/2008 Kawada
7,451,729 B2 11/2008 Sugiura et al.
7,503,297 B2 3/2009 Fujita et al.
7,503,298 B2 3/2009 Kinugawa et al.
7,591,238 B2 9/2009 Tateno et al.
7,644,698 B2 1/2010 Shiraishi et al.
7,685,979 B2 3/2010 Akasaka et al.
7,721,692 B2 5/2010 Fischer
7,748,358 B2 7/2010 Tanabe et al.
7,761,221 B2 7/2010 Abe et al.
7,845,324 B2 12/2010 Gecim et al.
8,011,335 B2 * 9/2011 Park et al. ..... 123/90.16
8,061,311 B2 11/2011 Nakamura
8,118,002 B2 2/2012 Lee et al.
8,127,727 B2 3/2012 Methley et al.
8,297,240 B2 10/2012 Inoue et al.
8,770,161 B2 * 7/2014 Gunnarsson ..... 123/90.16
8,794,204 B2 * 8/2014 Hayman et al. ..... 123/90.44
2001/0039932 A1 11/2001 Sekiya et al.
2002/0007810 A1 1/2002 Pierik
2002/0043230 A1 4/2002 Kinugawa
2002/0129779 A1 9/2002 Suzuki
2003/0041823 A1 3/2003 Takemura et al.
2003/0127063 A1 7/2003 Wang
2003/0154940 A1 8/2003 Pierik
2003/0172888 A1 9/2003 Miura
2003/0213451 A1 11/2003 Aoyama et al.
2003/0217715 A1 11/2003 Pierik
2004/0003789 A1 1/2004 Kreuter
2004/0099231 A1 5/2004 Methley
2004/0226527 A1 11/2004 Borraccia et al.
2005/0076868 A1 4/2005 Mott et al.
2006/0021590 A1 2/2006 Bosl-Flierl et al.
2006/0207532 A1 9/2006 Fujita et al.
2006/0260574 A1 11/2006 Schon et al.
2006/0266317 A1 11/2006 Fujita et al.
2007/0125329 A1 6/2007 Rohe et al.
2007/0193538 A1 8/2007 Best et al.
2007/0266973 A1 11/2007 Lancefield et al.
2007/0295292 A1 12/2007 Sugiura et al.
2009/0025666 A1 1/2009 Tateno et al.
2009/0031972 A1 2/2009 Tanabe et al.
2009/0194048 A1 8/2009 Schoen et al.
2009/0205595 A1 8/2009 Lee et al.
2010/0083922 A1 4/2010 Riley
2010/0132644 A1 6/2010 Methley et al.
2011/0107989 A1 5/2011 Ohsawa
2011/0197838 A1 8/2011 Yamaguchi et al.

* cited by examiner

VARIABLE VALVE TIMING APPARATUS AND INTERNAL COMBUSTION ENGINE INCORPORATING THE SAME

FIELD OF THE INVENTION

The present invention relates generally to variable valve trains for internal combustion engines, and specifically to valve trains for an internal combustion engine in which the timing of the valve event can be modified during operation of the internal combustion engine.

BACKGROUND OF THE INVENTION

Cylinder valves for internal combustion engines are generally opened and closed to allow for the intake and exhaust of gases in cylinders of internal combustion engines. Cylinder valves are generally operated by various valve lifter mechanisms including rocker arms and roller finger follower assemblies. The timing of the opening and closing of a cylinder valve (relative to the phase of crankshaft) is important to maximize fuel efficiency, assure complete combustion, and maximize engine output. Adjusting valve timing can lead to improvements in fuel economy, engine emissions, torque and idle quality.

Many different approaches have been proposed for providing adjustable valve timing. Some prior art approaches include independent lifter control for each cylinder by means of electrical solenoids or by changing the pivot point for a rocker arm. Various other approaches have also been proposed. Currently known approaches and assemblies for varying the timing of the valve event are either complex (and thus expensive) and/or are not well-suited for certain engine types, such as small internal combustion engines utilized in lawn mowers and other appliances.

Thus, there is a need for a variable valve timing apparatus, and engine incorporating the same, that provides for variable valve timing that is simple, cost-effective to manufacture and/or compact.

SUMMARY OF THE INVENTION

The present invention relates to a variable valve timing apparatus, and internal combustion engine incorporating the same, that allows the timing of the opening and/or closing of intake and/or exhaust cylinder valves to be altered relative to a reference timing. As a result, the timing of the valve event can be adjusted relative to a phase of the crankshaft and/or the cycle of the pistons.

In one aspect, a variable valve timing apparatus is proposed for cooperating with a cam shaft to vary timing of an action of a first cylinder valve of a first cylinder of an internal combustion engine, the variable valve timing apparatus comprising: a timing shaft rotatable about a timing shaft axis and comprising a first eccentric; a first timing control member; a first arm rotatably coupled to the first timing control member about a first arm axis, the first arm comprising a first follower portion having a first surface in operable cooperation with a first cam of the cam shaft and a second surface in operable cooperation with the first cylinder valve; and the first timing control member operably coupled to the first eccentric of the timing shaft such that rotation of the timing shaft causes the first arm axis to rotate about the cam shaft axis, thereby angularly moving the first follower portion about the cam shaft axis between a first angular position and a second angular position to alter timing of the action of the first cylinder valve relative to a reference timing.

In another aspect, a variable valve timing apparatus is proposed for cooperating with a cam shaft to vary timing of an action of a first cylinder valve of a first cylinder of an internal combustion engine, the variable valve timing apparatus comprising: a first timing control member; a first arm rotatably coupled to the first timing control member about a first arm axis, the first arm comprising a first follower portion having a first surface in operable cooperation with a first cam of the cam shaft and a second surface in operable cooperation with the first cylinder valve; the first timing control member rotatable or movable to cause the first arm axis to rotate about the cam shaft axis, thereby angularly moving the first follower portion about the cam shaft axis between a first angular position and a second angular position to alter timing of the action of the first cylinder valve relative to a reference timing.

In a further aspect, a variable valve timing apparatus is proposed for cooperating with a cam shaft to vary timing of an action of a first cylinder valve of a first cylinder of an internal combustion engine, the variable valve timing apparatus comprising: a first timing control member rotatably mounted to the camshaft; a first arm rotatably coupled to the first timing control member about a first arm axis, the first arm comprising a first follower portion having a first surface in operable cooperation with a first cam of the cam shaft and a second surface in operable cooperation with the first cylinder valve; and wherein rotation of the first timing plate about the cam shaft axis causes the first arm axis to rotate about the cam shaft axis, thereby angularly moving the first follower portion about the cam shaft axis between a first angular position and a second angular position to alter timing of the action of the first cylinder valve relative to a reference timing.

In a yet further aspect, a variable valve timing apparatus is proposed for cooperating with a cam shaft to vary timing of intake and exhaust cylinder valves for a multi-cylinder internal combustion engine, the variable valve timing apparatus comprising: a timing shaft rotatable about a timing shaft axis and comprising first and second eccentrics, the timing shaft axis being substantially parallel to a cam shaft axis of the cam shaft, the timing shaft mounted in a space between a first cylinder block comprising a first cylinder and a second cylinder block comprising a second cylinder, an intake valve timing control assembly operably coupled to the first eccentric of timing shaft and to a cylinder intake valve of each of the first and second cylinders; an exhaust valve timing control assembly operably coupled to the second eccentric of the timing shaft and to a cylinder exhaust valve of each of the first and second cylinders; and wherein rotation of the timing shaft alters valve timing of the cylinder intake valves and the cylinder exhaust valves of the first and second cylinders relative to a reference timing.

In other aspects, internal combustion engines are proposed that incorporate the variable valve timing apparatus described above.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE DRAWINGS

Figure 1:
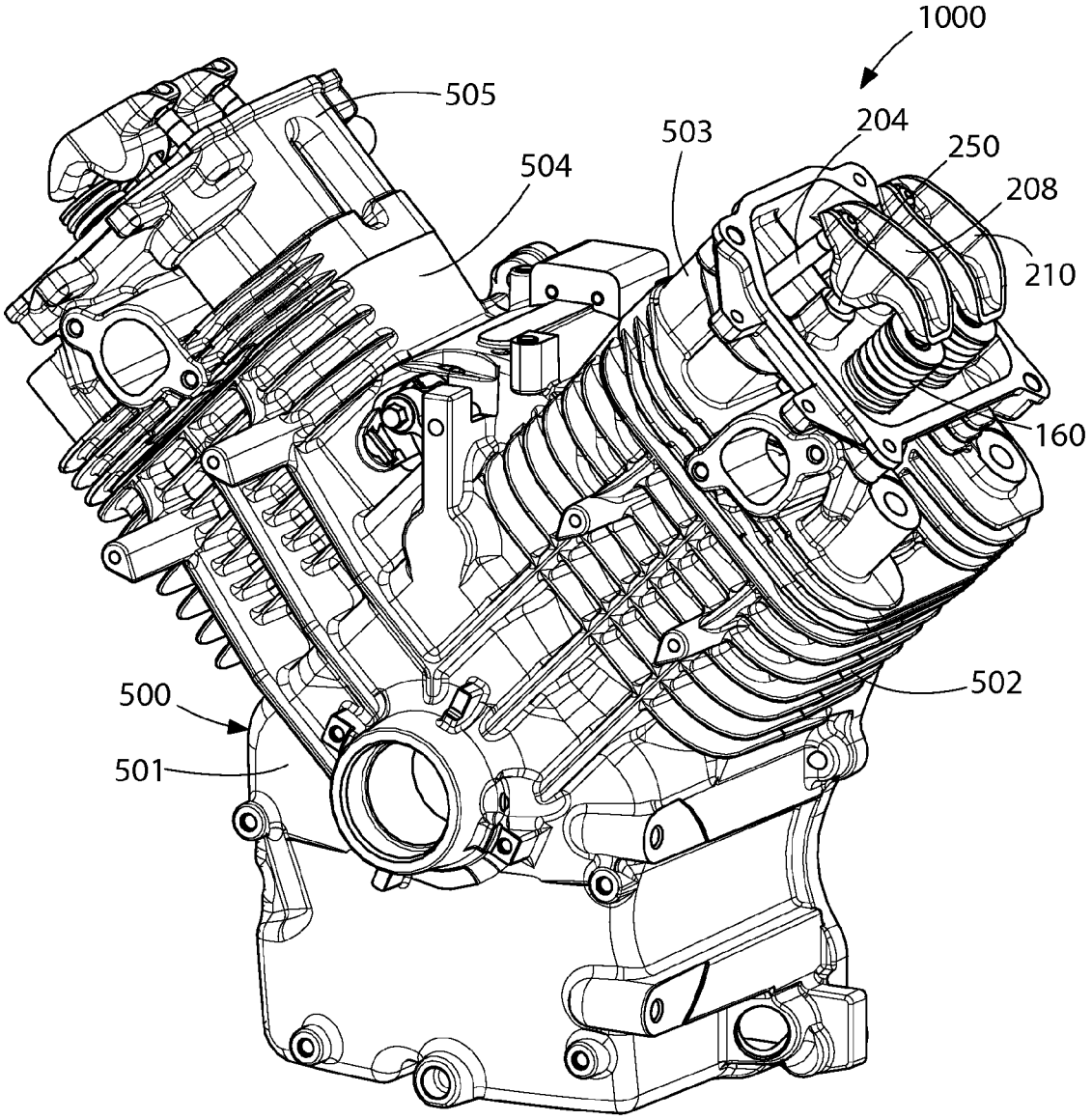
FIG. 1 is a perspective view of an internal combustion engine in accordance with the present invention.

The following description of embodiment(s) of the invention is merely exemplary in nature and is in no way intended to limit the invention, its application, or uses. The description of illustrative embodiments according to principles of the present invention is intended to be read in connection with the accompanying drawings, which are to be considered part of the entire written description. In the description of the exemplary embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the exemplary embodiments illustrated herein. Accordingly, the invention expressly should not be limited to such exemplary embodiments, even if indicated as being preferred. The discussion herein describes and illustrates some possible non-limiting combinations of features that may exist alone or in other combinations of features. The scope of the invention is defined by the claims appended hereto.

Figure 2:
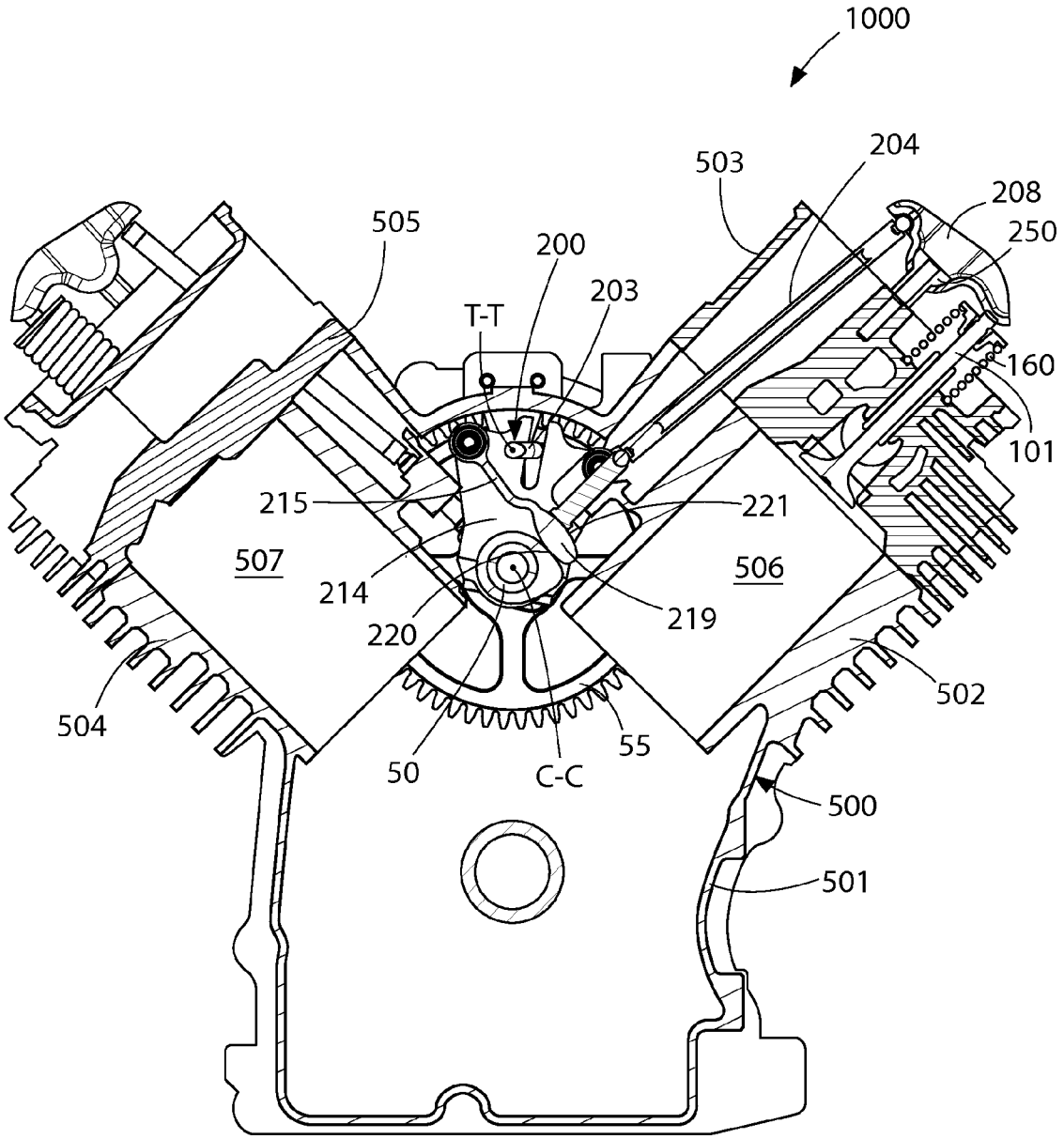
FIG. 2 is a cross-sectional view of the internal combustion engine of FIG. 1.
Figure 3:
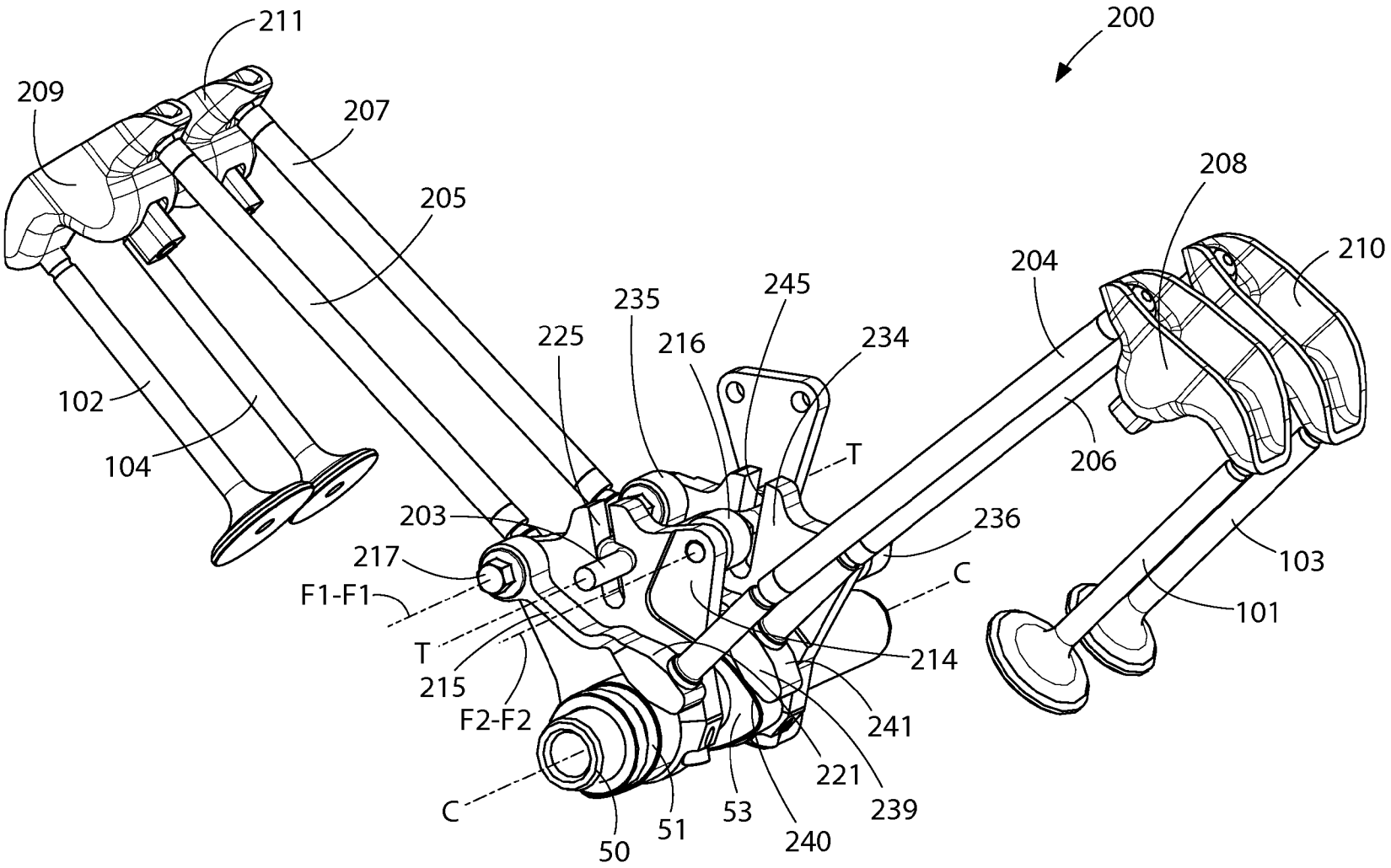
FIG. 3 is a perspective view of the variable valve timing apparatus ("VVTA") of the internal combustion engine of FIG. 1 removed therefrom.
Figure 4:
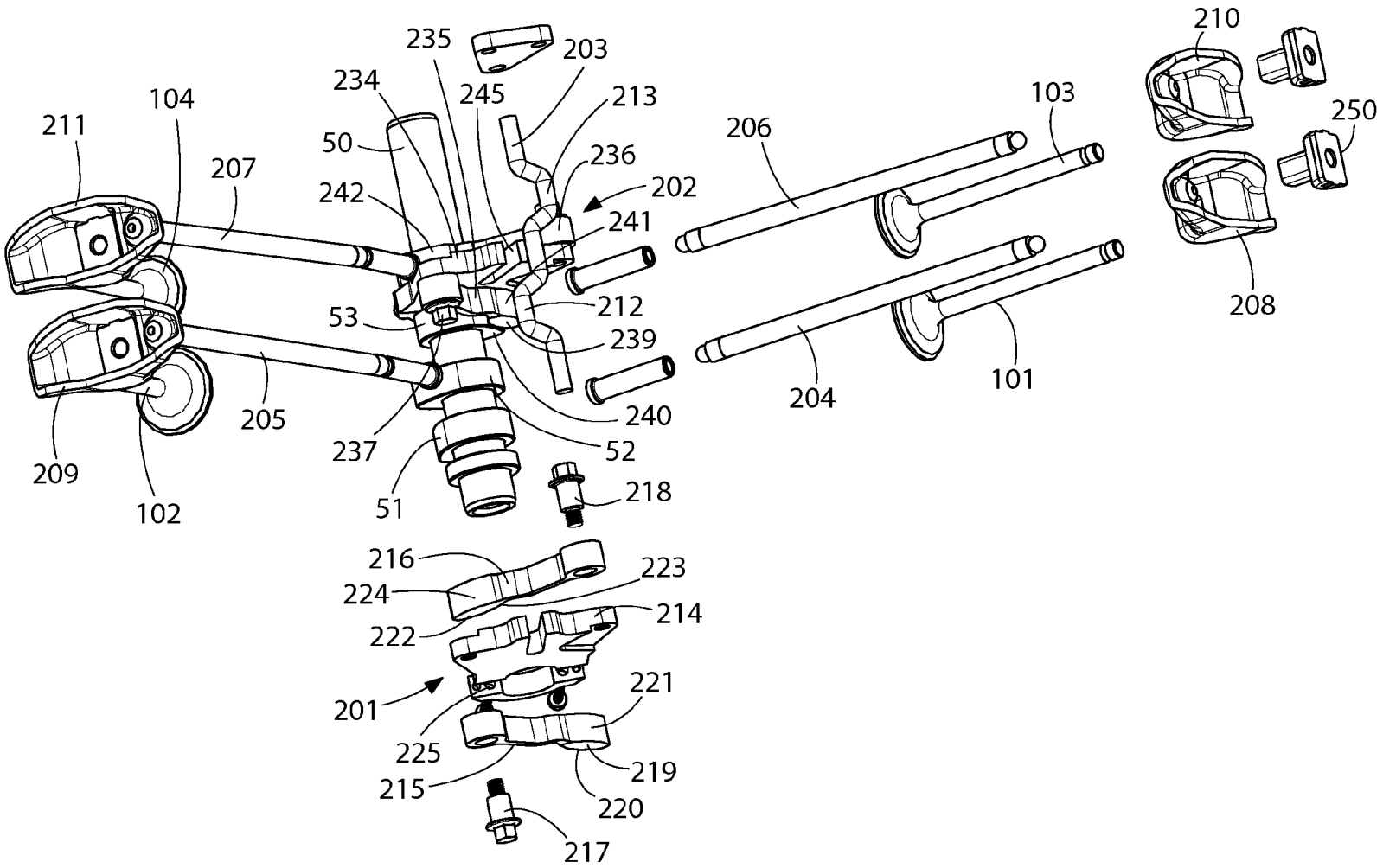
FIG. 4 is an exploded view of the VVTA of FIG. 3.
Figure 5:
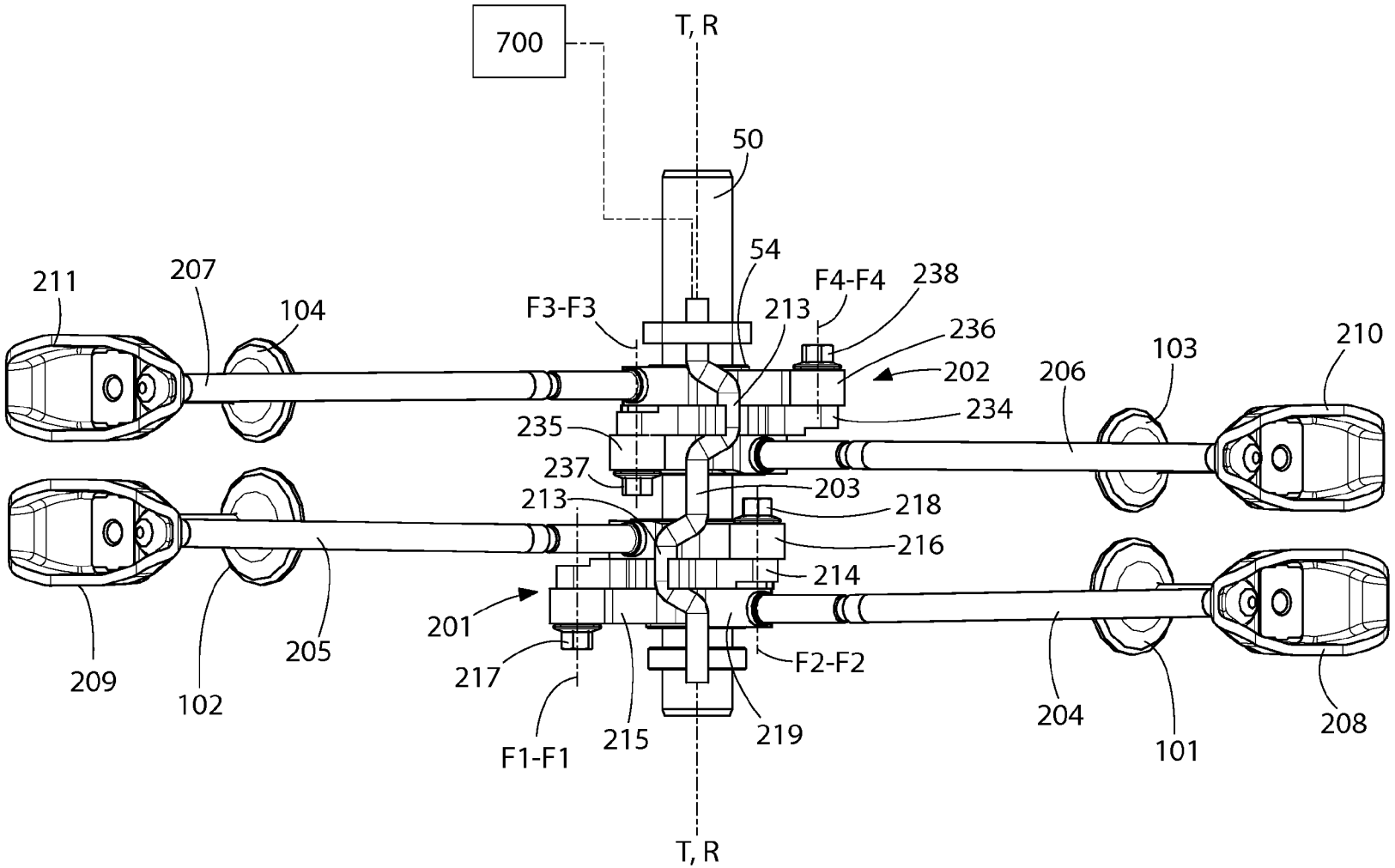
FIG. 5 is a top view of the VVTA of FIG. 3.

Referring first to FIGS. 1-3 concurrently, an internal combustion engine 1000 is exemplified. The internal combustion engine 1000, as exemplified, is a dual-cylinder engine of the vee type. The internal combustion engine 1000 may, however, comprise more or less than two cylinders and may take on other configurations, such as "in-line" or "straight" engine. The internal combustion engine 1000 may, for example, utilize a four-stroke cycle or a two-stroke cycle.

The internal combustion engine 1000 comprises an engine block 500, first and second pistons (not shown), and a crankshaft (not shown) operably coupled to the first and second pistons. The engine block 500 generally comprises a crankshaft case 501, a first cylinder block 502, a first cylinder head 503, a second cylinder block 504, and a second cylinder head 505. The engine block 500 can also comprise various covers and casings, such as valve covers (not shown), that are coupled to the one or more components mentioned above to form the structural foundation and housing of the internal combustion engine 1000. Thus, as used herein, when an element is said to be mounted (or otherwise coupled) to the engine block, such element may be mounted or coupled to any one, or combination, of the components identified above.

A first cylinder 506 is formed in the first cylinder block 502 and is enclosed at a top end thereof by the first cylinder head 503. A second cylinder 507 is formed in the second cylinder block 504 and is enclosed at a top end thereof by the second cylinder head 505. The first and second cylinders 506, 507 respectively accommodate the first and second pistons (not shown), which are in turn operably coupled to the crankshaft (not shown). The first and second cylinders 506, 507 act as combustion chambers in which an air/fuel mixture is introduced for ignition by one or more spark plugs (not shown).

The air/fuel mixture is introduced into the first and second cylinders 506, 507 via intake passageways (not shown) formed into the first and second cylinder heads 503, 505. The opening and closing of these intake passageways (and thus the intake of the air/fuel mixture into the first and second cylinders 506, 507) is controlled by first and second cylinder intake valves 101, 102 respectively. The first and second cylinder intake valves 101, 102 are opened and closed in coordinated timing with the rotational phase of the crankshaft. Similarly, exhaust gases resulting from the combustion of the air/fuel mixture within the first and second cylinders 506, 517, are exhausted therefrom through exhaust passageways (not shown) that are also formed in the first and second cylinder heads 503, 505. The opening and closing of these exhaust passageways (and thus the exhaust of the combustion gases from the first and second cylinders 506, 507) is controlled by third and fourth cylinder exhaust valves 103, 104. The third and fourth cylinder exhaust valves 103, 104 are opened and closed in coordinated timing with the rotational phase of the crankshaft. As exemplified, each of the first and second cylinder intake valves 101, 102 and the third and fourth cylinder exhaust valves 103, 104 are poppet valves. However, the cylinder valves are not so limited and can take on other structural forms.

The internal combustion engine 1000 also comprises a cam shaft 50 that is rotatably mounted to the engine block 500 (more specifically to the crankcase 501) for rotation about a cam shaft axis C-C (shown as a point in FIG. 2). The cam shaft 50 comprises a cam 51-54 for each of the cylinder valves 101-104. As exemplified, the cam shaft 50 comprises first and second intake cams 51, 52 and third and fourth exhaust cams 53, 54. While four cams are exemplified, the cam shaft 50 may comprise more or less cams as required. The rotation of the cam shaft 50 is driven by the rotation of the crankshaft. This coordinated rotation can be accomplished by a plurality of mechanisms, including without limitation a gear 55 that engages a gear (or gear train) that is operably coupled to the crankshaft. Alternatively, a belt and pulley system can be used. Because the cams 51-54 respectively effectuate the opening and closing of the cylinder valves 101-104 (discussed in greater detail below), a reference timing of the opening and closing of the cylinder valves 101-104 is established in relation to the crankshaft phase (and in relation to the piston cycle).

The internal combustion engine 1000 also comprises a variable valve timing apparatus ("VVTA") 200 that cooperates with the cam shaft 50 to alter the timing of the opening and closing of the cylinder valves 101-104 relative to the reference timing. Thus, the VVTA 200 can be utilized to either advance and/or retard the valve timing events (i.e., opening and closing) of the cylinder valves 101-104 in relation to the reference timing.

By altering the valve timing events using the VVTA 200 (i.e., advancing and/or retarding), certain desirable characteristics can be achieved for the internal combustion engine 1000, such as optimizing engine torque output and/or decreasing exhaust gas emissions. For example, by advancing the valve timing events at low to medium engine speeds, torque can be improved. To the contrary, by retarding the valve timing events at high speeds, torque can be improved. Furthermore, altering the valve timing events using the VVTA 200 can also result in decreased exhaust gas emissions by trapping the exhaust gas in the first and second cylinders 506, 507 (i.e., the combustion chambers) to reduce combustion temperature at part load. Additionally, the closing event of the third and fourth cylinder exhaust valves 103, 104 can be advanced to trap exhaust gases in the first and second cylinders 506, 507 by poor scavenging. On the other hand, the closing event of the third and fourth cylinder exhaust valves 103, 104 can be retarded to allow exhaust gases to flow back into the first and second cylinders 506, 507 during the intake strokes of the pistons. The VVTA 200 can be configured to automatically adjust the valve timing events of the cylinders valves 101-104 to achieve a desired output of the internal combustion engine 1000 using both engine speed and load conditions as inputs.

Turning now to FIGS. 2-6 concurrently, the details of the VVTA 200 and its cooperation with the cam shaft 50 and the cylinder valves 101-104 will be described in greater detail. The VVTA 200 generally comprises an intake valve timing control assembly 201, an exhaust valve timing control assembly 202, a timing shaft 203, first and second intake valve rods (also referred to as "pushrods") 204-205, third and fourth exhaust valve rods (or "pushrods") 206-207, first and second intake rocker members 208-209, and third and fourth exhaust rocker members 210-211. When the VVTA 200 is assembled within the internal combustion engine 1000, the timing shaft 203 is rotatably mounted to the engine block 500 (more specifically to the crankcase 501) for rotation about a timing shaft axis T-T. As exemplified, the timing shaft axis T-T is substantially parallel to the cam shaft axis C-C. In other arrangements, the timing shaft axis T-T may not be substantially parallel to the cam shaft axis C-C but can ne oblique or orthogonal.

As exemplified, the timing shaft 203 and cam shaft 50 are rotatably mounted to the engine block 500 within a space formed between the first and second cylinder blocks 502,504. The cam shaft 50 is located below the timing shaft 203. The timing shaft 203 and the cam shaft 50 may, however, be rotatably mounted to the engine block 500 in other locations and in other relative orientations and arrangements.

The timing shaft 203 comprises a first eccentric 212 and a second eccentric 213. The first eccentric 212 is operably coupled to the intake valve timing control assembly 201 so that rotation of the timing shaft 203 actuates the intake valve timing control assembly 201 to either advance or retard the timing of the valve events for the first and second intake valves 101, 102 (discussed in greater detail below). Similarly, the second eccentric 213 is operably coupled to the exhaust valve timing control assembly 202 so that rotation of the timing shaft 203 actuates the exhaust valve timing control assembly 202 to either advance or retard the timing of the valve events for the third and fourth exhaust valves 103, 104 (discussed in greater detail below). As exemplified, each of the first and second eccentrics 212, 213 are in the form of bent portions of the timing shaft 203 that are "off-axis" relative to the timing shaft axis T-T. Alternatively, either or both of the first and second eccentrics 212, 213 can take the form of cams having one or more cam lobes that create the desired eccentricity.

The intake valve timing control assembly 201 generally comprises: (1) a first timing control member 214 operably coupled to the first eccentric 212 of the timing shaft 203; (2) a first arm 215 rotatably mounted to first timing control member 214 for relative rotation about a first arm axis F1-F1; and (3) a second arm 216 rotatably mounted to the first control member 214 for relative rotation about a second arm axis F2-F2. As exemplified, both the first arm axis F1-F1 and the second arm axis F2-F2 are substantially parallel to one another and to each of the cam shaft axis C-C and the timing shaft axis T-T. In alternate arrangements, one or more the axes may not be parallel to one another but may, rather be obliquely or orthogonally arranged.

The first arm 215 is rotatably mounted on a first axial side of the first timing control member 214 via a first pin 217. The second arm 216 is rotatably mounted on a second axial side (opposite the first axial side) of the first timing control member 214 via a second pin 218. Additionally, the first and second arms 215, 216 are also rotatably mounted to the first timing control member 214 at opposite lateral sides of the first timing control member 214 and, thus, extend radially from the first and second arm axes F1-F1, F2-F2 in opposite circumferential directions relative to the cam shaft axis C-C.

The first and second arms 215, 216 may, in some configurations, be rotatably coupled to the first timing control member 214 so that the first and second arm axes F1-F1, F2-F2 are substantially co-linear. In one such arrangement, the first and second arms 215, 216 can be rotatably mounted to the first timing control member 214 via the same pin element.

As exemplified, the first timing control member 214 is a plate that extends substantially perpendicular to the cam shaft axis C-C and comprises a first major surface and second major surface. The first arm 215 is rotatably mounted adjacent the first major surface of the first timing control member 214 while the second arm 216 is rotatably mounted adjacent the second major surface of the first timing control member 214. The first timing control member 214, however, is not limited to a plate-like structure and can take the form of suitably shaped bars or rods.

The first arm 215 comprises a proximal end that is rotatably mounted to the first timing control member 214 and a distal end that comprises a first follower portion 219. The first follower portion 219 comprises a first surface 220 and a second surface 221. The second surface 221 is opposite the first surface 220. The first surface 220 of the first follower portion 219 is in operable cooperation with the first intake cam 51 of the cam shaft 50 while the second surface 221 of the first follower portion 219 is in operable cooperation with the first cylinder intake valve 101 (indirectly through the first intake valve rod 204). The second surface 221 of the first follower portion 219 may be a convex surface having a substantially constant radius of curvature that is concentric with a base circle surface of the first intake cam 51. This may reduce or eliminate variation of the valve lash for the first cylinder intake valve 101.

Similarly, the second arm 216 comprises a proximal end that is rotatably mounted to the first timing control member 214 and a distal end that comprises a second follower portion 222. The second follower portion 222 comprises a first surface 223 and a second surface 224. The second surface 224 is opposite the first surface 223. The first surface 223 of the second follower portion 222 is in operable cooperation with a second intake cam 52 of the cam shaft 50 while the second surface 224 of the second follower portion 222 is in operable cooperation with the second cylinder intake valve 102 (indirectly through the second intake valve rod 205). The second surface 224 of the second follower portion 222 may be a convex surface having a substantially constant radius of curvature that is concentric with a base circle surface of the second intake cam 52. This may reduce or eliminate variation of the valve lash for the second cylinder intake valve 102.

The first timing control member 214 is rotatably mounted at the bottom end thereof to the cam shaft 50 so as to be capable of rotation/oscillation about the cam shaft axis C-C. More specifically, the first timing control member 214 is rotatably mounted to the cam shaft 50 at an axial position between the first and second intake cams 51, 52 of the cam shaft 50. This arrangement is useful when the first and second arms 215, 216 are located on opposite sides of the first timing control member 214. However, if the first and second arms 215, 216 were located on the same axial side of the first timing control member 214, the first and second intake cams 51, 52 may be located on the same axial side of the of the first timing control member 214. In such an arrangement, the first and second arms 215, 216 may be axially offset from one another using an extension sleeve so as to prevent interference.

A first elongated slot 225 is provided in the top end of the first timing control member 214 (opposite the end that is rotatably coupled to the cam shaft 50). The first elongated slot 225 receives the first eccentric 212 for operable cooperation therewith. As exemplified, the first elongated slot 225 is an open end slot that extends from a top edge of the first timing control member 214. Alternatively, the first elongated slot 225 may be a closed-geometry slot.

As a result of the interaction between the first eccentric 212 and the walls of the first elongated slot 225, rotation/oscillation of the timing shaft 203 causes the first timing control member 214 to rotate/oscillate about the cam shaft axis C-C, thereby causing the first arm axis F1-F1 and the second arm axis F2-F2 to also rotate about the cam shaft axis C-C. More specifically, each of the first arm axis F1-F1 and the second arm axis F2-F2 travel along paths that are concentric with the cam shaft axis C-C. As discussed in greater detail below, this results in: (1) the first follower portion 219 of the first arm 215 angularly moving about the cam shaft axis C-C between a first angular position (FIG. 7A) and a second angular position (FIG. 7B) to alter timing of the opening/closing of the first cylinder intake valve 101 relative to the reference timing; and (2) the second follower portion 222 of the second arm 216 angularly moving about the cam shaft axis C-C between a third angular position (FIG. 7A but not visible) and a fourth angular position (FIG. 7B but not visible) to alter timing of the opening/closing of the second cylinder intake valve 102 relative to the reference timing.

Turning now to the exhaust control of the VVTA 200, the exhaust valve timing control assembly 202 generally comprises: (1) a second timing control member 234 operably coupled to the second eccentric 213 of the timing shaft 203; (2) a third arm 235 rotatably mounted to the second timing control member 234 for relative rotation about a third arm axis F3-F3; and (3) a fourth arm 236 rotatably mounted to the first control member 234 for relative rotation about a fourth arm axis F4-F4. As exemplified, both the third arm axis F3-F3 and the fourth arm axis F4-F4 are substantially parallel to one another and to each of the cam shaft axis C-C and the timing shaft axis T-T. In alternate arrangements, however, one or more the axes may not be parallel to one another but may rather be obliquely or orthogonally oriented.

The third arm 235 is rotatably mounted on a first axial side of the second timing control member 234 via a third pin 237. The fourth arm 236 is rotatably mounted on a second axial side (opposite the first axial side) of the second timing control member 234 via a fourth pin 238. As exemplified, the third and fourth arms 235, 236 are also rotatably mounted to the second timing control member 234 at opposite lateral sides of the second timing control member 234. Thus, third and fourth arms 235, 236 respectively extend radially from the third and fourth arm axes F3-F3, F4-F4 in opposite circumferential directions relative to the cam shaft axis C-C.

Alternatively, the third and fourth arms 235, 236 can be rotatably coupled to the second timing control member 234 so that the third and fourth arm axes F3-F3, F4-F4 are substantially co-linear. In one such an embodiment, the third and fourth arms 235, 236 can be rotatably mounted to the second timing control member 234 via the same pin element.

As exemplified, the second timing control member 234 is a plate that extends substantially perpendicular to the cam shaft axis C-C and comprises a first major surface and second major surface. The third arm 235 is rotatably mounted to the second timing control member 234 adjacent the first major surface of the second timing control member 234. The fourth arm 236 is rotatably mounted to the second timing control member 234 adjacent the second major surface of the second timing control member 234. The second timing control member 234, however, is not limited to a plate-like structure and can take the form of suitably shaped bars or rods.

The third arm 235 comprises a proximal end that is rotatably mounted to the second timing control member 234 and a distal end that comprises a third follower portion 239. The third follower portion 239 comprises a first surface 240 and a second surface 241. The second surface 241 is opposite the first surface 240. The first surface 240 of the third follower portion 239 is in operable cooperation with a third exhaust cam 53 of the cam shaft 50 while the second surface 241 is in operable cooperation with the third cylinder intake valve 103 (indirectly through the third intake valve rod 206). The second surface 241 of the third follower portion 239 may be a convex surface having a substantially constant radius of curvature that is concentric with a base circle surface of the third exhaust cam 53. This may reduce or eliminate variation of the valve lash for the third cylinder exhaust valve 103.

Similarly, the fourth arm 236 comprises a proximal end that is rotatably mounted to the second timing control member 234 and a distal end that comprises a fourth follower portion 242. While not visible, the fourth follower portion 242 comprises a first surface and a second surface (identical to the second follower portion 222). The first surface of the fourth follower portion 242 is in operable cooperation with a fourth exhaust cam 54 of the cam shaft 50 while the second surface of the fourth follower member 242 is in operable cooperation with the fourth cylinder exhaust valve 104 (indirectly through the fourth exhaust valve rod 206). The second surface of the fourth follower portion 242 may be a convex surface having a substantially constant radius of curvature that is concentric with a base circle surface of the fourth exhaust cam 54. This may reduce or eliminate variation of the valve lash for the fourth cylinder intake valve 104.

The second timing control member 234 is rotatably mounted at a bottom end thereof to the cam shaft 50 so as to be capable of rotation/oscillation about the cam shaft axis C-C. More specifically, the second timing control member 234 is rotatably mounted to the cam shaft 50 axially between the third and fourth exhaust cams 53, 54 of the cam shaft 50. This arrangement can be used when the third and fourth arms 235, 236 are located on opposite axial sides of the second timing control member 234. When the third and fourth arms 235, 236 are located on the same axial side of the second timing control member 234, however, the third and fourth exhaust cams 53, 54 may also be located on the same axial side of the of the second timing control member 234. In such an arrangement, the third and fourth arms 235, 236 may be axially offset from one another using an extension sleeve so as to prevent interference.

A second elongated slot 245 is provided in the top end of the second timing control member 234 (opposite the end that is rotatably coupled to the cam shaft 50). The second elongated slot 245 operably receives the second eccentric 213. As exemplified, the second elongated slot 245 is an open end slot that extends from a top edge of the second timing control member 234. Alternatively, the second elongated slot 245 may be a closed-geometry slot.

As a result of the interaction between the second eccentric 213 and the walls of the second elongated slot 245, rotation/oscillation of the timing shaft 203 causes the second timing control member 234 to rotate/oscillate about the cam shaft axis C-C, thereby causing the third arm axis F3-F3 and the fourth arm axis F4-F4 to also rotate about the cam shaft axis C-C. More specifically, each of the third arm axis F3-F3 and the fourth arm axis F4-F4 travel along paths that are concentric with the cam shaft axis C-C. As discussed in greater detail below, this results in: (1) the third follower portion 239 of the third arm 235 angularly moving about the cam shaft axis C-C between a fifth angular position (FIG. 7A but not visible) and a sixth angular position (FIG. 7B but not visible) to alter timing of the opening/closing of the third cylinder exhaust valve 103 relative to the reference timing; and (2) the fourth follower portion 242 of the fourth arm 236 angularly moving about the cam shaft axis C-C between a seventh angular position (FIG. 7A but not visible) and an eighth angular position (FIG. 7B but not visible) to alter timing of the opening/closing of the fourth cylinder exhaust valve 104 relative to the reference timing.

As exemplified, the first and second eccentrics 212, 213 are configured on the timing shaft 203 so that rotation/oscillation of the timing shaft 203 causes the first and second timing control members 214, 234 to rotate about the cam shaft axis C-C in opposite angular directions with the same magnitude of angular displacement. However, the timing shaft 203 (and/or the first and second eccentrics 212, 213) can be configured so that rotation/oscillation of the timing shaft 203 causes the first and second timing control members 214, 234 to rotate about the cam shaft axis C-C in the same angular direction and/or with the different magnitudes of angular displacement. Additionally, while a single timing shaft is illustrated, more than one timing shaft may be used to separately control the first and second timing control members 214, 234.

As shown above, the first timing control member 214 controls the timing of the intake cylinder valves 101, 102 while the second timing control member 234 controls the timing of the exhaust cylinder valves 103, 104. Alternatively, the VVTA 200 may be modified so that a separate timing control member is included for each of the cylinder valves 101-104, thereby affording individualized adjustment of the timing for each individual cylinder valve 101-104. In still further aspects, the VVTA 200 may be modified such that the first timing control member 214 controls at least one of the cylinder exhaust valves 103, 104 and one of cylinder intake valves 101, 102. Similarly, the VVTA 200 may also be modified such that the second timing control member 234 controls at least one of the cylinder intake valves 101, 102 and one of cylinder exhaust valves 103, 104. Thus, the same timing control member may be used to control both intake and exhaust valves if desired.

Figure 6:
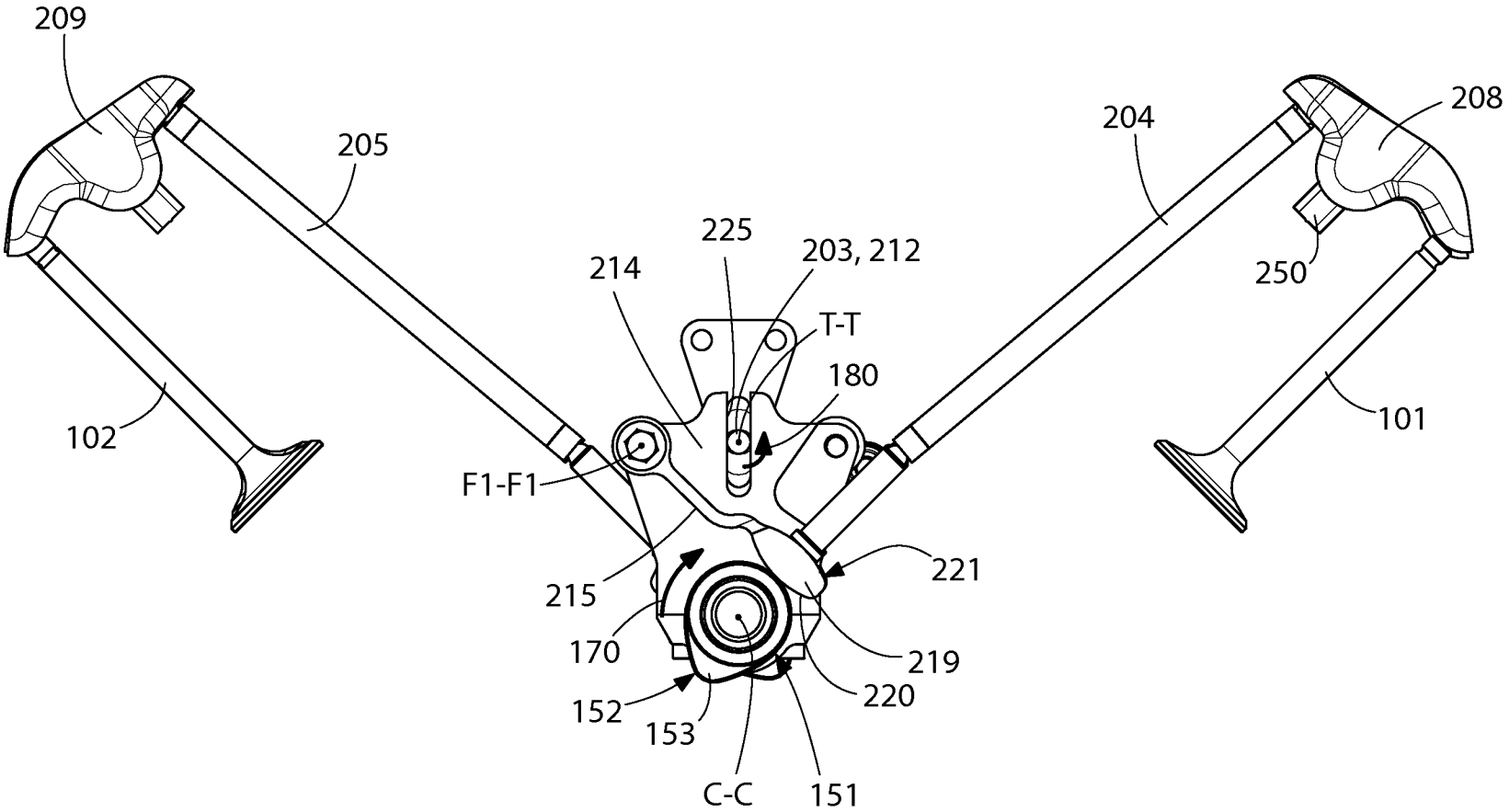
FIG. 6 is a front view of the VVTA of FIG. 3.

Referring now to FIGS. 2 and 6 concurrently, the basic actuation (i.e., opening and closing) of the first cylinder intake valve 101 using the first intake cam 51 and the first arm 215 will be described with the understanding that the same principles and structures are applicable to the operation of each of the other cylinder valves 102-104 (respectively using the arms 216, 235, 236 and cams 52-54). As mentioned above, the opening and closing of the first cylinder intake valve 101 is controlled by the first intake cam 51. The first intake cam 51 comprises at least one first cam lobe 153. Thus, the first intake cam 51 comprises a first base circle surface 151 and a first cam lobe surface 152. The first base circle surface 151 is concentric with the cam shaft axis C-C. The first cam lobe surface 152, however, is not concentric with the cam shaft axis C-C but rather protrudes radially outward.

The first cylinder intake valve 101 is operably coupled to a first end of the first intake rocker member 208. A first end of the first intake valve rod 204 is operably coupled to the second end of the first intake rocker member 208. The first intake rocker member 208 is rotatably mounted to the engine block 500 by the first intake rocker pivot 205 so that the first intake rocker member 208 can pivot/rock about a rocker arm axis. More specifically, the first intake rocker member 208 is rotatably mounted to the first cylinder head 503. A first biasing element, in the form of a first valve spring 160, is provided that biases the first cylinder intake valve 101 into a closed state.

In addition to biasing the first cylinder intake valve 101 into the closed state, the first valve spring 160 forces the first cylinder intake valve 101 to transmit a torque to the first intake rocker member 208 that, in turn, biases the second end of the first intake valve rod 204 into surface contact with the second surface 221 of the first follower portion 219. The biasing force exerted by the first intake valve rod 204 on the second surface 221 of the first follower portion 219, in turn, biases and maintains the first surface 220 of the first follower portion 219 in surface contact with the first intake cam 51.

During rotation of the cam shaft 50, when the first surface 220 of the first follower portion 219 is in contact with the first base circle surface 151, the first intake valve 101 remains in the closed-state. However, as the first intake cam 51 continues to rotate such that the first cam lobe surface 152 comes into contact with and slides over the first surface 220 of the first follower portion 219, the resulting interaction overcomes the bias force of the first valve spring 160 and causes the first arm 215 to pivot about the first arm axis F1-F1 in a first angular direction (which is counterclockwise in FIG. 6). As a result, the first follower portion 219 lifts the first intake valve rod 204, causing the first intake rocker member 208 to rock/pivot, which, in turn, actuates the first cylinder intake valve 101 into an open state. As the first intake cam 51 continues to rotate, the first cam lobe surface 152 moves past the first surface 220 of the first follower portion 219 and the interaction between the two ceases. As a result, the biasing force of the first valve spring 160 causes the first arm 215 to pivot about the first arm axis F1-F1 again, but this time in a second angular direction (clockwise in FIG. 6), thereby returning the first cylinder intake valve 101 to the closed state.

Figure 7A:
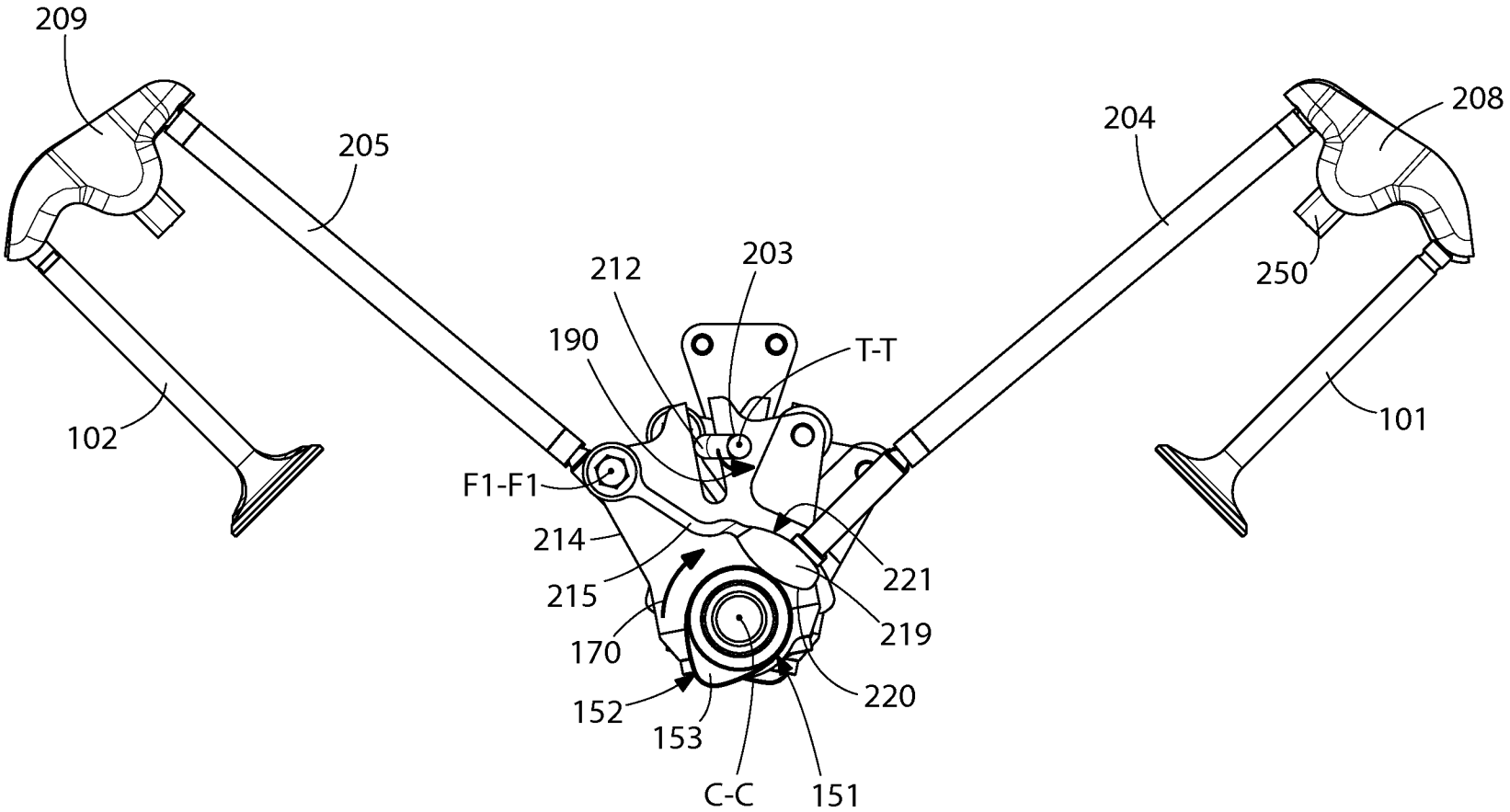
FIG. 7A is front view of the VVTA of FIG. 3, wherein the timing of the actions of the first and second intake cylinder valves has been advanced relative to a reference timing.
Figure 7B:
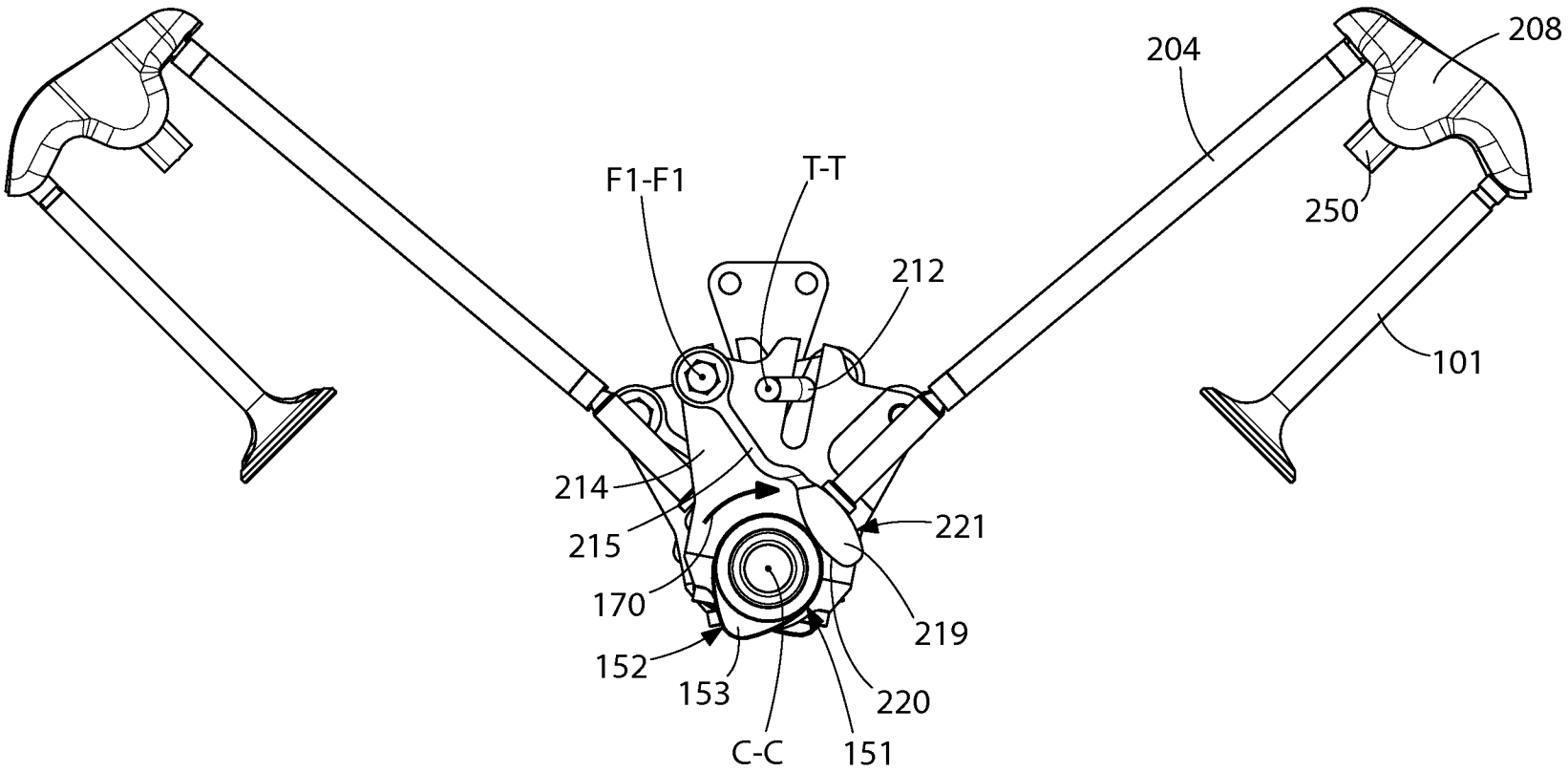
FIG. 7B is front view of the VVTA of FIG. 3 wherein the timing of the actions of the first and second cylinder intake valves has been retarded relative to the reference timing.

Referring now to FIGS. 6, 7A and 7B concurrently, adjustment of the timing of the valve event/action of the first cylinder intake valve 101 with the VVTA 200 will be described. It is to be understood that the discussion below is equally applicable to the other cylinder valves 102-103 through their associated components.

As shown in FIG. 6, the timing of the valve event/action (i.e., opening and closing) of the first cylinder intake valve 101 can be considered to occurring at a reference timing when in the illustrated position. In this state, the timing shaft 203 in FIG. 6 is in a rotational position such that the first follower portion 219 of the first arm 215 can be considered to be at a reference angular position about the cam shaft axis C-C.

In this example, the cam shaft 50 is assumed to be rotating in the clockwise angular direction, as indicated by arrow 170. Thus, in order to advance the timing of the valve event/action of the first cylinder intake valve 101 using the VVTA 200, the timing shaft 203 is rotated counterclockwise, indicated by arrow 180. As a result of said counterclockwise rotation of the timing shaft 203, the first eccentric 212 causes the first timing control member 214 to rotate counterclockwise about the cam shaft axis C-C. As such, the first arm axis F1-F1 also rotates about the cam shaft axis C-C along a path that is concentric with the cam shaft axis C-C. This, in turn, causes the first follower portion 219 to angularly move from the reference angular position (FIG. 6) to the first angular position (FIG. 7A). As a result of the first follower portion 219 of the first arm 215 being in the first angular position, the first cam lobe surface 152 contacts the first surface 220 of the first follower portion 219 at an advanced timing relative to the reference timing (and, thus, earlier in the cycle of the corresponding piston).

To the contrary, in order to retard the timing of the valve event/action of the first cylinder intake valve 101, the timing shaft 203 is rotated clockwise, indicated by arrow 190. As a result of said clockwise rotation of the timing shaft 203, the first eccentric 212 causes the first timing control member 214 to pivot clockwise about the cam shaft axis C-C. As such, the first arm axis F1-F1 also rotates about the cam shaft axis C-C along a path that is concentric with the cam shaft axis C-C. This, in turn, causes the first follower portion 219 to angularly move from the first angular position (FIG. 7A) (or from the reference angular position of FIG. 6) to the second angular position (FIG. 7B). As a result of the first follower portion 219 of the first arm 215 being in the second angular position, the first cam lobe 152 contacts the first surface 220 of the first follower portion 219 at a retarded timing relative to the reference timing (and, thus, later in the cycle of the corresponding piston).

As discussed above, it is the rotation (and rotational position) of the timing shaft 203 that controls the timing of the valve event. Thus, the internal combustion engine 1000 further comprises a control unit 700 (schematically illustrated in FIG. 5) that is operably coupled to the timing shaft 203. The control unit 700 may be configured to rotate the timing shaft 203 to alter timing of the valve event/action of the cylinder valves 101-104 relative to the reference timing based on a variable engine operating condition, such as engine speed or load. The control unit 700 can be any type of system or subsystem known in the art for adjusting valve timing based on engine operating conditions and can include mechanical and electronic feedback and control systems. For example, the control unit 700, in one aspect can comprise a hydraulic cylinder, a vacuum motor, an electric motor, or an electronic linear or rotary actuator. These actuators can be controlled by a computer that receives signals indicative of measured operating conditions of the internal combustion engine 1000 and automatically adjusts/rotates the timing shaft 203 to a predetermined rotational position in accordance with a stored control algorithm. Alternatively, mechanical control systems, such as hydraulic systems and gear trains can be utilized.

Finally, while the first surfaces of the follower portions 219, 222, 239, 242 of the arms 215, 216, 235, 236 are exemplified above as being in slidable surface contact with their respective cam 51-54, it is to be understood that the follower portions 219, 222, 239, 242 could comprise rollers. In such configurations, the rollers may comprise the first surfaces of the follower portion 219, 222, 239, 242.

Figure 8:
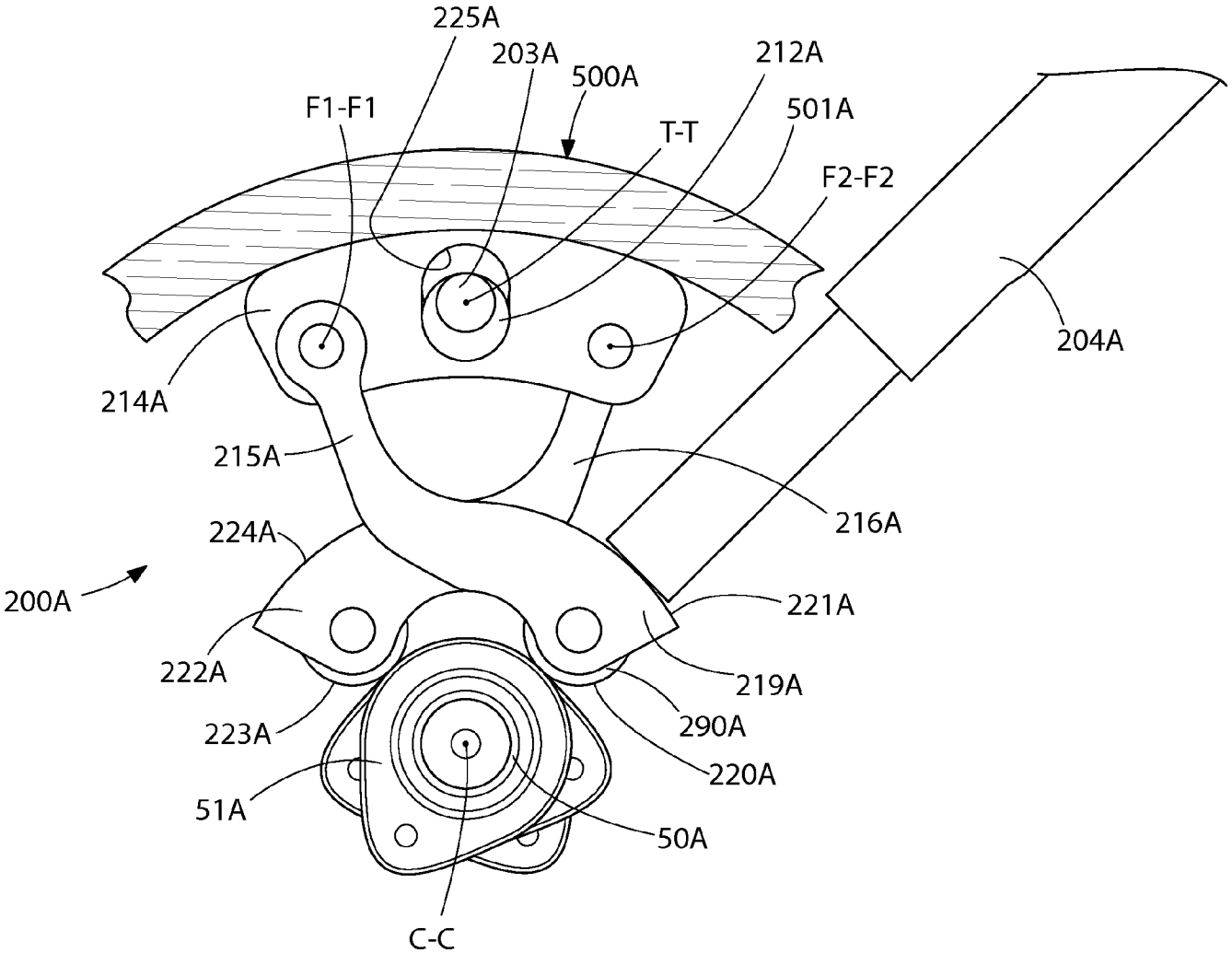
FIG. 8 is a front view of an internal combustion engine in accordance with the present invention, wherein the timing control members of the VVTA are movably mounted to the engine block.

Referring now to FIG. 8, a VVTA 200A in accordance with aspects of the present invention is illustrated. The VVTA 200A is structurally and functionally identical to the VVTA 200 described above with certain exceptions. Thus only those aspect of the VVTA 200A that are different than the VVTA 200 will be described below with the understanding that all other components are essentially identical both structurally and/or functionally. Thus, like reference numbers will be used for like elements with the addition of the alphabetical suffix "A."

Unlike the VVTA 200, the first and second timing control members 214A, 234A of the VVTA 200A are not rotatably mounted to the cam shaft 50A. Rather, the first and second timing control member 214A, 234A are movably mounted to the engine block 500A (specifically to the crankshaft case 501A). More specifically, the first and second timing control members 214A, 234A are movably mounted to the engine block 500A so that they can be moved (such as by sliding) along a path that is concentric with the cam shaft axis C-C. As exemplified, the inner surface of the crank shaft case 501A to which the first and second timing control members 214A, 234A are movably mounted has a curvature that is concentric with the cam shaft axis C-C. Thus, the VVTA 200A can achieve the same valve timing adjustment function as discussed above for the VVTA 200 but is not restricted by being coupled to the cam shaft 50A.

As with the VVTA 200, moving/sliding the first control member 214A along the path that is concentric with the cam shaft axis C-C also results in the first and second arm axes F1-F1, F2-F2 to rotate about the cam shaft axis C-C along paths that are also concentric with the cam shaft axis C-C. It is in this manner that the VVTA 200A can be actuated to adjust the timing of the valve events. In such constructions, the first and second timing control members 214A, 234A can be slidably mounted in tracks formed into or coupled to the engine block. While the first and second timing control members 214A, 234A of the VVTA 200A are not rotatably coupled to the cam shaft 50A, the first and second timing control members 214A, 234A can still be considered to rotate about the can shaft axis C-C during said sliding/moving.

Similar to the VVTA 200, the first and second timing control members 214A, 234A of the VVTA 200A are moved along the paths that are concentric with the cam shaft axis C-C by rotation/oscillation of a timing shaft 203A. However, the first eccentric 212A is in the form of a cam rather than a bent portion of the timing shaft itself.

A further difference between VVTA 200A and VVTS 200 is that the VVTA 200A comprises rollers 290A, 290B that are provided on the first and second follower portions 219A, 222A respectively. Thus, in the VVTA 200A, the first roller 290A comprises the first surface 220A of the first follower portion 219A while the second roller 291A comprises the first surface 223A of the second follower portion 222A.

Figure 9A:
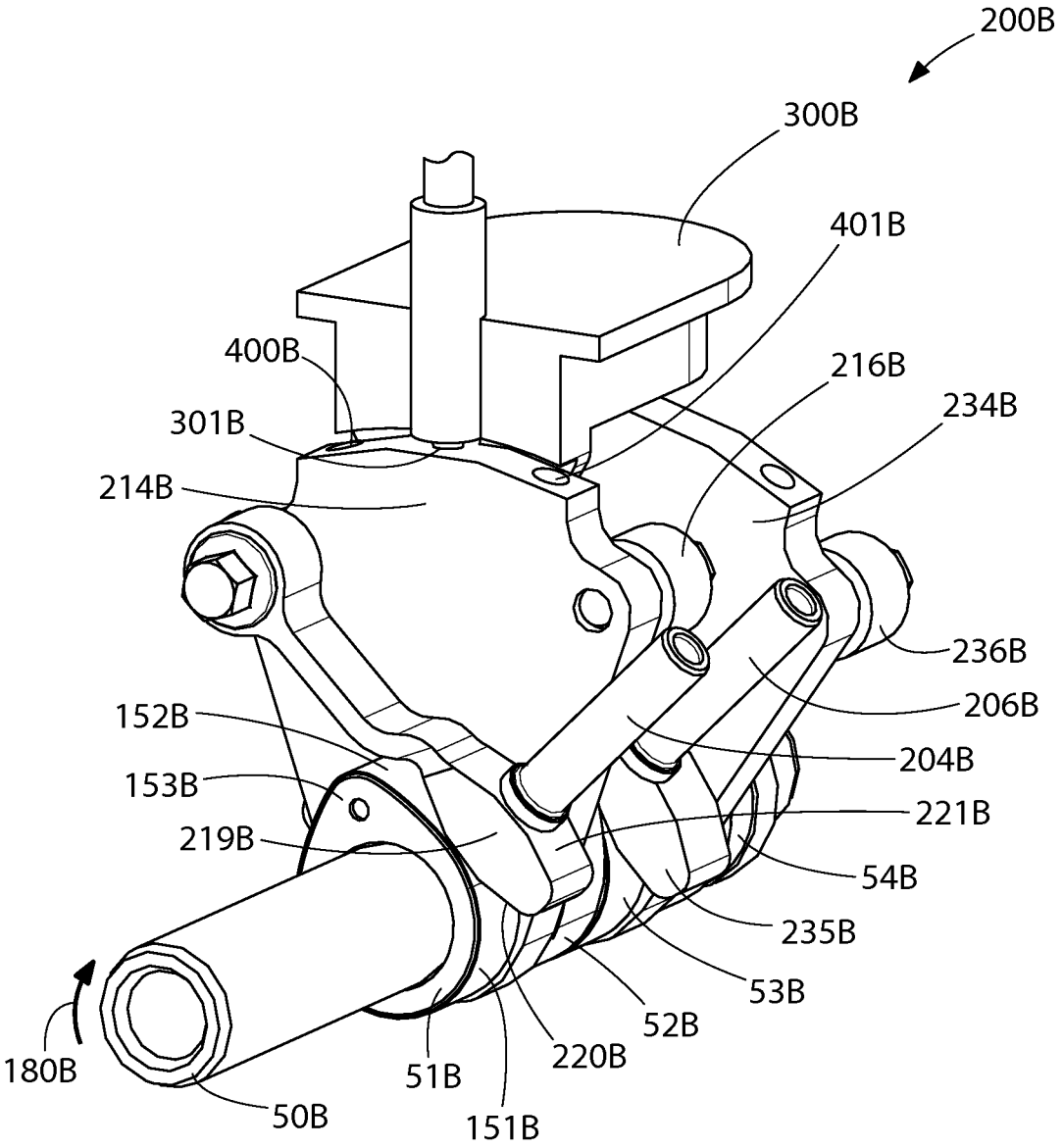
FIG. 9A is a perspective view of a VVTA in accordance with the present invention, wherein the timing control members are actuated by reactionary forces.
Figure 9B:
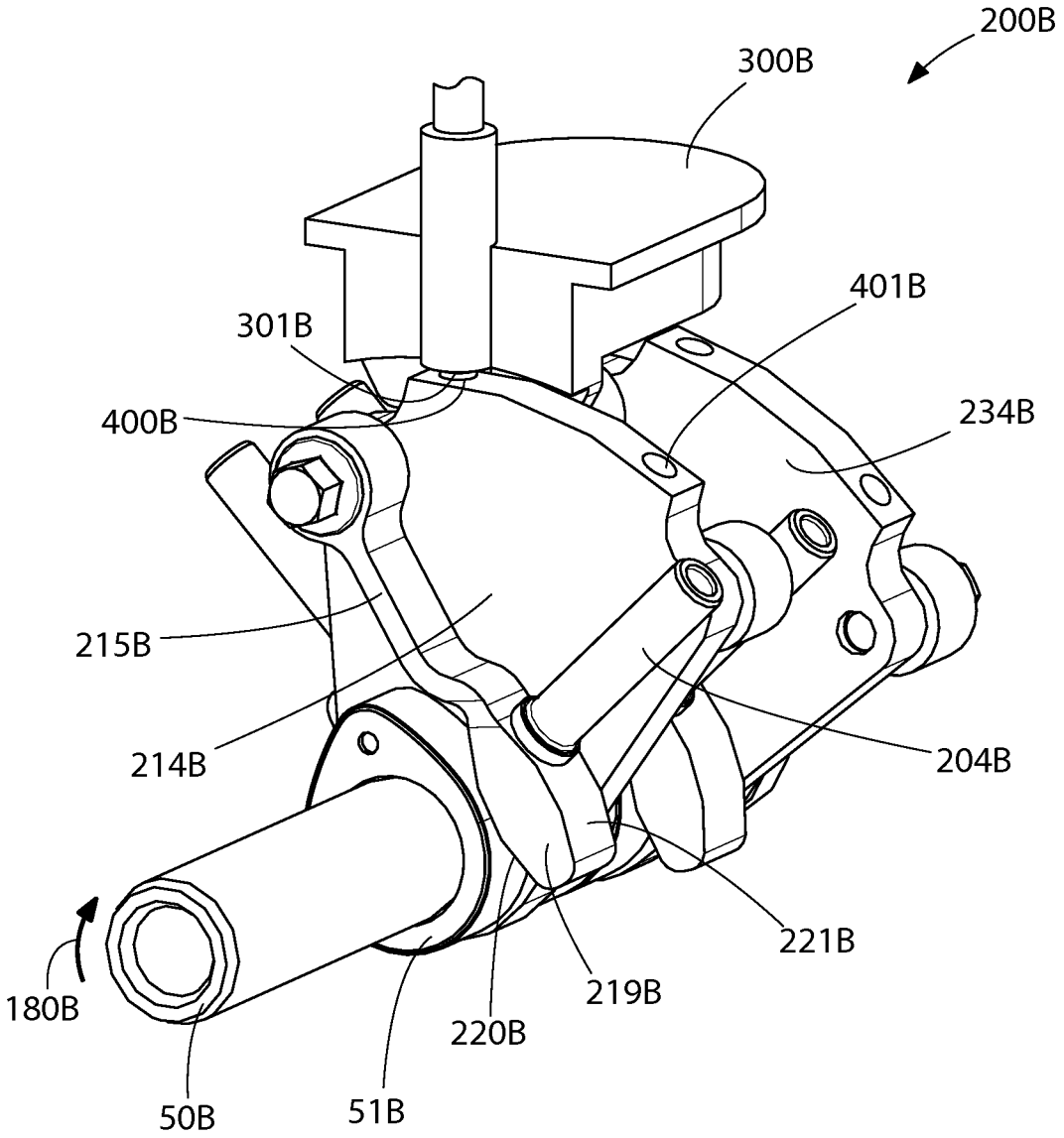
FIG. 9B is a perspective view the VVTA of FIG. 9A wherein a locking element is maintaining the first timing control member in a retarded angular position in which timing of the actions of the first and second intake cylinder valves has been retarded relative to a reference timing.
Figure 9C:
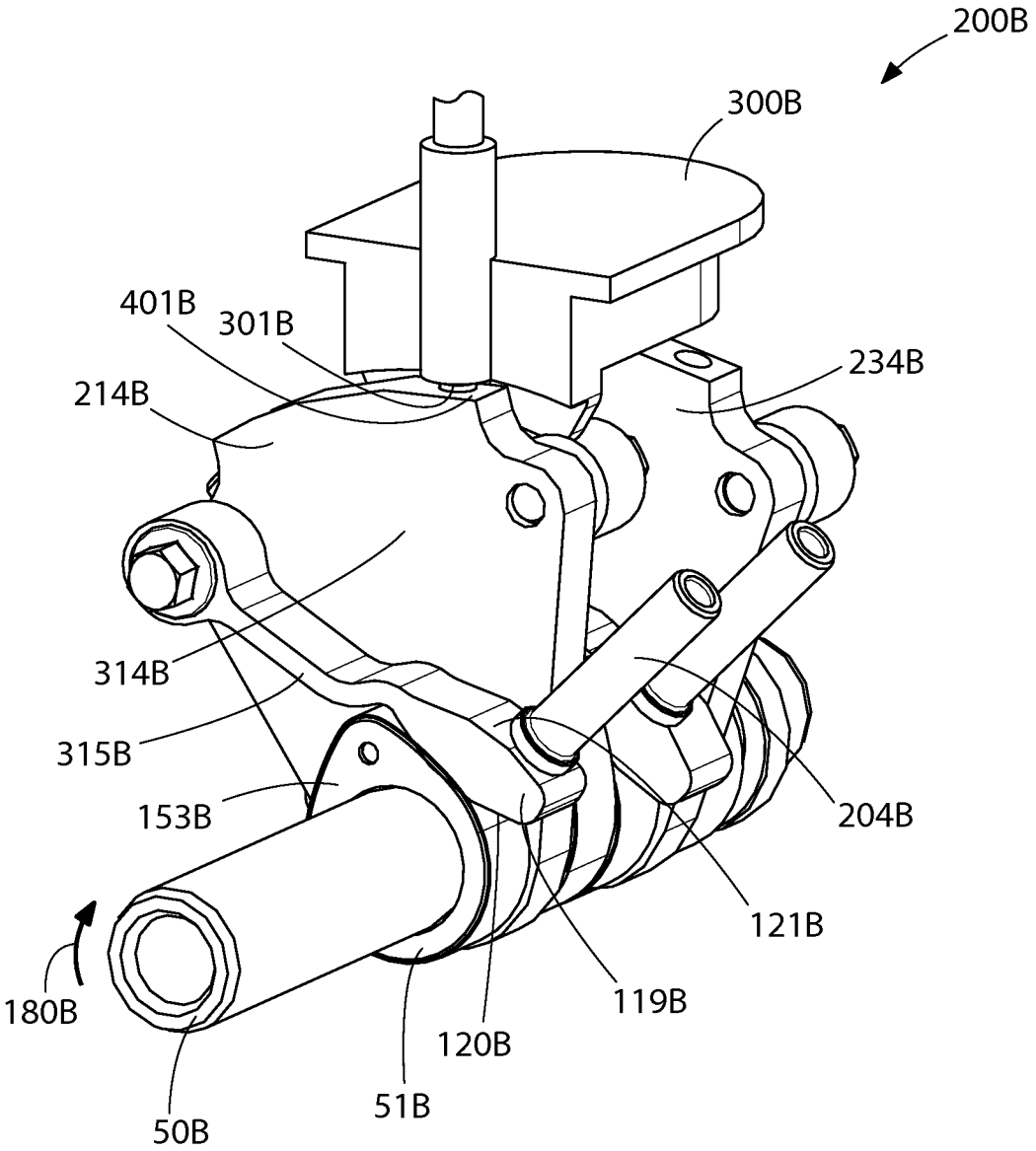
FIG. 9C is a perspective view the VVTA of FIG. 9A wherein the locking element is maintaining the first timing control member in an advanced position in which timing of the actions of the first and second cylinder valves has been advanced relative to a reference timing.

Turning now to FIGS. 9A-9C concurrently, another VVTA 200B in accordance with the invention is exemplified. Again, the VVTA 200B is structurally and functionally identical to the VVTA 200 described above with certain exceptions. Thus only those aspect of the VVTA 200B that are different than the VVTA 200 will be described below with the understanding that all other components are essentially identical both structurally and/or functionally. Thus, like reference numbers will be used for like elements with the addition of the alphabetical suffix "B."

The primary difference between the VVTA 200B and the VVTA 200 is that rotation/oscillation of the first and second timing control members 214B, 234B is not controlled by a timing shaft. Rather, as will be discussed below, the desired rotation of the first and second timing control members 214B, 234B is accomplished by taking advantage of reactionary forces that are generated during operation of the internal combustion engine 1000, in combination with timed locking/unlocking of the first and second timing control members 214B, 234B. Thus, for the VVTA 200B, the timing shaft can be omitted.

The VVTA 200B comprises a mounting member 300B to which an actuatable locking member 301B is operably mounted. As exemplified, the locking member 301B is in the form of a pneumatic locking pin. The locking member 301B can be actuated between an extended state (FIGS. 9B-C) and a retracted state (FIG. 9A). In the retracted state, the locking member 301B does not interfere with the movement (i.e., rotation/oscillation) of the first timing control member 214B. In the extended state, however, the locking member 301B can engage either of the first locking feature 400B or the second locking feature 401B of the first timing control member 21413 to prohibit further movement (i.e., rotation/oscillation) of the first timing control member 214B. As exemplified, the first and second locking features 400B, 401B are in the form of detents but can take on other structures, such as protuberances.

In one configuration, the locking member 301B is biased into the extended state. In another configuration, the locking member 301B is biased into the retracted state. Actuation of the locking member 301B (i.e., moving between the retracted and extended states) can be accomplished, for example, by hydraulic pressure, an electromagnet, an electric motor, a linear actuator, or the like. The timing of said actuation of the locking member 301 can be controlled by a mechanical or electrical control unit, such as that which is described above for the control unit 700. As will be discussed below, actuation of the locking member 301 between the extended and retracted states is controlled so that the first timing control member 214B can be selectively allowed to move between an advanced angular position in which timing of the valve events is advanced and a retarded angular position in which timing of the valve events is retarded.

The mounting member 300B is supported adjacent the top edge of the first timing control member 214B so that the locking member 301B can interact with the first timing control member 214B as discussed below. While not illustrated, a second mounting member and second locking member can be provided to control the second timing control member 234B.

Beginning with FIG. 9A, the cam shaft 50B is assumed to be rotating clockwise, as indicated by arrow 180B. Rotation of the cam shaft 50B also rotates the cams 51B-54B in the clockwise direction. For ease of discussion, and to avoid duplicity, it will be described how the reactionary forces experienced by the first arm 215B contribute to the rotation/oscillation of the first timing control member 214B with the understanding that the discussion is applicable to the other arms 216B, 235B, 236B.

As described above for the VVTA 200, the first follower portion 219B of the first arm 2158B is biased into contact with the first intake cam 51B by the first valve spring 160B. As the cam shaft 50B rotates clockwise, the first cam lobe 153B approaches the first follower portion 219B until the first cam lobe surface 152B comes into contact with the first surface 220B of the first follower portion 219B. Due to the contours/shapes of the first cam lobe surface 152B and the first surface 220B, the contact between the first cam lobe surface 152B and the first surface 220B generates a reactionary force that exerts a clockwise torque on the first timing control member 214B. At this stage, the locking member 301B is in the retracted state. Thus, the clockwise torque exerted on the first timing control member 214B causes the first timing control member 214B to rotate clockwise about the cam shaft 50B.

This clockwise angular movement continues until the first timing control member 214B reaches a retarded angular position (FIG. 9B). At this time, the locking member 301B is actuated into the extended state so that the locking member 301B mates with the first locking feature 400B of the first timing control member 214B, thereby locking the first timing control member 214B in the retarded angular position. It should be apparent from the discussion above that in the retarded angular position the timing of the valve events is retarded relative to the reference timing. Once the locking member is in the extended state, the first timing control member 214B is prohibited from rotating out of this retarded angular position due to the mating between the locking member 301B and the first locking feature 400B of the first timing control member 214B.

When it is desired to no longer have the valve event timing retarded, the locking member 301B is actuated into the retracted state. As discussed above, due to the spring force of the locking spring 160B, a tappet of the first intake valve rod 204B is biased against the second surface 221B of the first follower portion 219B. Due to the contours/shapes of the second surface 221B and/or the orientation of the tappet, the bias force of the valve spring 160 generates a reactionary force that exerts a counterclockwise torque on the first timing control member 214B. Because the locking member 301B is in the retracted state, this counterclockwise torque causes the first timing control member 214B to rotate counterclockwise about the cam shaft SOB.

This counterclockwise rotation continues until the first timing control member 2148 reaches an advanced angular position (FIG. 9C). At this time, the locking member 301B is actuated into the extended state so that the locking member 301B mates with the second locking feature 401B of the first timing control member 214B, thereby locking the first timing control member 214B in the advanced angular position. It should be apparent from the discussion above that in the advanced angular position the timing of the valve events is advanced. The first timing control member 214B is prohibited from rotating out of this advanced angular position due to mating between the locking member 301B and the first locking feature 400B of the first timing control member 214B.

Thus, through properly timing the actuation and state of the locking member 301B, the VVTA 200B can adjust the timing of the valve events in response to an operating condition of the internal combustion engine to achieve a desired effect.

In certain configurations, the first timing control member 214B may be spring loaded to assist with rotation in one of the angular directions discussed above. Furthermore, additional locking features could be included on the first timing control member 214B so that the first timing control member 214B can be maintained in additional angular positions.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A variable valve timing apparatus for cooperating with a cam shaft to vary timing of an action of a first cylinder valve of a first cylinder of an internal combustion engine, the variable valve timing apparatus comprising:

a timing shaft rotatable about a timing shaft axis and comprising a first eccentric;

a first timing control member;

a first arm rotatably coupled to the first timing control member so as to be rotatable relative to the first timing control member about a first arm axis, the first arm comprising a first follower portion having a first surface in operable cooperation with a first cam of the cam shaft and a second surface in operable cooperation with the first cylinder valve; and the first timing control member rotatably mounted to the cam shaft and operably coupled to the first eccentric of the timing shaft such that rotation of the timing shaft causes the first arm axis to rotate about the cam shaft axis and the first timing control member to rotate about the cam shaft axis, thereby angularly moving the first follower portion about the cam shaft axis between a first angular position and a second angular position to alter timing of the action of the first cylinder valve relative to a reference timing.

2. The variable valve timing apparatus according to claim 1 wherein the cam shaft is rotatable about a cam shaft axis, the timing shaft axis being substantially parallel to the cam shaft axis; and wherein the first arm axis is substantially parallel to the timing shaft axis.

3. The variable valve timing apparatus according to claim 1 wherein the first arm axis travels along a path that is concentric with the cam shaft axis during rotation of the timing shaft.

4. The variable valve timing apparatus according to claim 1 wherein the first cam comprises a first cam lobe surface that interacts with the first surface of the first follower portion of the first arm to cause the first arm to pivot about the first arm axis in a first angular direction, thereby opening the first cylinder valve.

5. The variable valve timing apparatus according to claim 4 further comprising a first valve rod and a first rocker member mounted to an engine block of the internal combustion engine, a first end of the first valve rod in surface contact with the second surface of the first follower portion and a second end of the first valve rod operably coupled to the first rocker member, the first valve operably coupled to the first rocker member.

6. The variable valve timing apparatus according to claim 5 further comprising a first biasing element, the biasing element biasing the first cylinder valve into a closed state, the first end of the first valve rod in contact with the second surface of the first follower portion, and the first surface of the first follower portion into contact with the first cam.

7. The variable valve timing apparatus according to claim 6 wherein the interaction between the first cam lobe and the first surface of the first follower portion overcomes a bias force of the biasing element to pivot the first arm about the first arm axis in the first angular direction, and wherein upon the interaction between the first cam lobe surface and the first surface of the first follower portion ceasing, the biasing force of the biasing element causes the first arm to pivot about the first arm axis in a second angular direction, thereby returning the first cylinder valve to the closed state.

8. The variable valve timing apparatus according to claim 1 further comprising a control unit operably coupled to the timing shaft, the control unit configured to rotate the timing shaft to alter timing of the action of the first cylinder valve relative to the reference timing based on a variable engine operating condition.

9. The variable valve timing apparatus according to claim 1 wherein the first timing control member comprises a first plate having a first major surface and a second major surface, wherein the first arm is located adjacent the first major surface.

10. A variable valve timing apparatus for cooperating with a cam shaft to vary timing of an action of a first cylinder valve of a first cylinder of an internal combustion engine, the variable valve timing apparatus comprising:

a timing shaft rotatable about a timing shaft axis and comprising a first eccentric;

a first timing control member;

a first arm rotatably coupled to the first timing control member about a first arm axis, the first arm comprising a first follower portion having a first surface in operable cooperation with a first cam of the cam shaft and a second surface in operable cooperation with the first cylinder valve;

the first timing control member operably coupled to the first eccentric of the timing shaft such that rotation of the timing shaft causes the first arm axis to rotate about the cam shaft axis, thereby angularly moving the first follower portion about the cam shaft axis between a first angular position and a second angular position to alter timing of the action of the first cylinder valve relative to a reference timing;

a second arm rotatably coupled to the first timing control member about a second arm axis, the second arm comprising a second follower portion comprising a first surface in operable cooperation with a second cam of the cam shaft and a second surface in operable cooperation with a second cylinder valve of a second cylinder of the internal combustion engine; and wherein rotation of the timing shaft causes the second arm axis to rotate about the cam shaft axis, thereby angularly moving the second follower portion about the cam shaft axis between a third angular position and a fourth angular position to alter timing of an action of the second cylinder valve relative to the reference timing.

11. The variable valve timing apparatus according to claim 10 wherein the first and second arms are located on opposite axial sides of the first timing control member.

12. The variable valve timing apparatus according to claim 11 wherein the first timing control member is rotatably mounted to the cam shaft between the first and second cams of the cam shaft.

13. The variable valve timing apparatus according to claim 10 wherein the first timing control member is mounted to an engine block of the internal combustion engine to move along a path that is concentric with the cam shaft axis.

14. A variable valve timing apparatus for cooperating with a cam shaft to vary timing of intake and exhaust cylinder valves for a multi-cylinder internal combustion engine, the variable valve timing apparatus comprising:

a timing shaft rotatable about a timing shaft axis and comprising first and second eccentrics, the timing shaft axis being substantially parallel to a cam shaft axis of the cam shaft, the timing shaft mounted in a space between a first cylinder block comprising a first cylinder and a second cylinder block comprising a second cylinder;

an intake valve timing control assembly operably coupled to the first eccentric of timing shaft and to a cylinder intake valve of each of the first and second cylinders;

an exhaust valve timing control assembly operably coupled to the second eccentric of the timing shaft and to a cylinder exhaust valve of each of the first and second cylinders; and wherein rotation of the timing shaft alters valve timing of the cylinder intake valves and the cylinder exhaust valves of the first and second cylinders relative to a reference timing.

15. The variable valve timing apparatus according to claim 14 further comprising:

the intake valve timing control assembly comprising:

a first timing control member operably coupled to the first eccentric;

a first arm rotatably mounted to first timing control member and comprising a first follower portion, the first follower portion having a first surface in operable cooperation with a first intake cam of the cam shaft and a second surface in operable cooperation with the cylinder intake valve of the first cylinder; and a second arm rotatably mounted to the first control member and comprising a second follower portion, the second follower portion having a first surface in operable cooperation with a second intake cam of the cam shaft and a second surface in operable cooperation with the cylinder intake valve of the second cylinder; and the exhaust valve timing control assembly comprising:

a second timing control member operably coupled to the second eccentric;

a third arm rotatably mounted to the second control member and comprising a third follower portion, the third follower portion having a first surface in operable cooperation with a first exhaust cam of the cam shaft and a second surface in operable cooperation with the cylinder exhaust of the first cylinder; and a fourth arm rotatably mounted to the second control member and comprising a fourth follower portion, the fourth portion having a first surface in operable cooperation with a second exhaust cam of the cam shaft and a second surface in operable cooperation with the cylinder exhaust valve of the second cylinder.

16. The variable valve timing apparatus according to claim 15 wherein rotation of the timing shaft angularly displaces: (1) the first and second follower portions about the cam shaft axis to alter the valve timing of the cylinder intake valves of the first and second cylinders; and (2) the third and fourth follower portions about the cam shaft axis to alter the valve timing of the cylinder exhaust valves of the first and second cylinders.

17. A variable valve timing apparatus for cooperating with a cam shaft to vary timing of an action of a first cylinder valve of a first cylinder of an internal combustion engine, the variable valve timing apparatus comprising:

a first timing control member;

a first arm rotatably coupled to the first timing control member about a first arm axis, the first arm comprising a first follower portion having a first surface in operable cooperation with a first cam of the cam shaft and a second surface in operable cooperation with the first cylinder valve; and the first timing control member rotatable or movable to cause the first arm axis to rotate about the cam shaft axis along a path that is concentric with the cam shaft axis, thereby angularly moving the first follower portion about the cam shaft axis between a first angular position and a second angular position to alter timing of the action of the first cylinder valve relative to a reference timing.

18. The variable valve timing apparatus according to claim 17 wherein the first surface of the first follower portion is configured so that a reactionary force between a cam lobe surface of the first cam and the first surface the first follower portion generates a torque on the first timing control member in a first angular direction, and wherein the second surface of the first follower portion is configured so that a biasing force exerted by a biasing element and transmitted to the second surface of the first follower portion by a valve rod generates a torque on the first timing control member in a second angular direction.

19. The variable valve timing device of claim 18 further comprising:

a locking member;

the first timing control member comprising a first locking feature and a second locking feature;

a control unit operably coupled to the locking member, the control unit selectively actuating the locking member for engagement and disengagement with the first locking feature or the second locking feature;

wherein when the locking member engages the first locking feature, the first timing control member is prohibited from rotating or moving and the first follower portion is maintained in the first angular position; and wherein when the locking member engages the second locking feature, the first timing control member is prohibited from rotating or moving and the first follower portion is maintained in the second angular position.

20. The variable valve timing apparatus according to claim 17 wherein the first timing control member is rotatably mounted to the cam shaft.

21. A variable valve timing apparatus for cooperating with a cam shaft to vary timing of an action of a first cylinder valve of a first cylinder of an internal combustion engine, the variable valve timing apparatus comprising:

a first timing control member;

a first arm rotatably coupled to the first timing control member about a first arm axis, the first arm comprising a first follower portion having a first surface in operable cooperation with a first cam of the cam shaft and a second surface in operable cooperation with the first cylinder valve;

the first timing control member rotatable or movable to cause the first arm axis to rotate about the cam shaft axis, thereby angularly moving the first follower portion about the cam shaft axis between a first angular position and a second angular position to alter timing of the action of the first cylinder valve relative to a reference timing;

wherein the first surface of the first follower portion is configured so that a reactionary force between a cam lobe surface of the first cam and the first surface the first follower portion generates a torque on the first timing control member in a first angular direction, and wherein the second surface of the first follower portion is configured so that a biasing force exerted by a biasing element and transmitted to the second surface of the first follower portion by a valve rod generates a torque on the first timing control member in a second angular direction;

a locking member;

the first timing control member comprising a first locking feature and a second locking feature;

a control unit operably coupled to the locking member, the control unit selectively actuating the locking member for engagement and disengagement with the first locking feature or the second locking feature;

wherein when the locking member engages the first locking feature, the first timing control member is prohibited from rotating or moving and the first follower portion is maintained in the first angular position; and wherein when the locking member engages the second locking feature, the first timing control member is prohibited from rotating or moving and the first follower portion is maintained in the second angular position.

* * * * *